US010261445B2

(12) United States Patent
Sabo et al.

(10) Patent No.: US 10,261,445 B2
(45) Date of Patent: Apr. 16, 2019

(54) LATCHES FOR HOLDING PRINTING DEVICE ROLLERS IN CONTACT WITH END CAPS

(71) Applicant: HP INDIGO B.V., Amstelveen (NL)

(72) Inventors: David Sabo, San Diego, CA (US); John W. Godden, San Diego, CA (US)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 15/748,189

(22) PCT Filed: Oct. 28, 2015

(86) PCT No.: PCT/US2015/057855
§ 371 (c)(1),
(2) Date: Jan. 28, 2018

(87) PCT Pub. No.: WO2017/074360
PCT Pub. Date: May 4, 2017

(65) Prior Publication Data
US 2018/0224771 A1 Aug. 9, 2018

(51) Int. Cl.
*G03G 15/10* (2006.01)
*G03G 15/08* (2006.01)

(52) U.S. Cl.
CPC ..... *G03G 15/10* (2013.01); *G03G 15/0894* (2013.01); *G03G 15/0896* (2013.01)

(58) Field of Classification Search
CPC ..... G03G 15/10
USPC ..... 399/239
See application file for complete search history.

(56) References Cited

U.S. PATENT DOCUMENTS

| | | | |
|---|---|---|---|
| 5,794,103 | A | 8/1998 | Oh |
| 6,631,251 | B2 | 10/2003 | Morganti et al. |
| 6,754,460 | B2 | 6/2004 | Lewis et al. |
| 8,787,800 | B2 | 7/2014 | Tanner et al. |
| 8,855,527 | B2 | 10/2014 | Pingel et al. |
| 2011/0170904 | A1 | 7/2011 | Sudo et al. |
| 2012/0242769 | A1 | 9/2012 | Murray et al. |
| 2013/0223888 | A1 | 8/2013 | Tanner et al. |
| 2014/0140735 | A1 | 5/2014 | Oda |
| 2015/0195419 | A1 | 7/2015 | Xu et al. |

FOREIGN PATENT DOCUMENTS

WO 2015076870 A1 5/2015

OTHER PUBLICATIONS

Sabo et al., WO2017074360, Written Opinion, dated Oct. 18, 2015, 7 pages.
Sabo et al., WO2017074360, International Search Report, dated Oct. 18, 2015, 3 pages.

*Primary Examiner* — Quana Grainger
(74) *Attorney, Agent, or Firm* — Wall & Tong LLP

(57) ABSTRACT

Examples of printing devices are described. Such printing devices may include an end cap having an engaging portion and a hook portion, a roller, and a latch unit to hold the roller in contact with the end cap when the latch unit is in a closed position. The latch unit may include a latch having a protrusion to engage with the engaging portion of the end cap, and a spring attached to the end cap and to the latch. In one example, the hook portion of the end cap is to hold the latch in a closed position in counteraction to a force provided by the spring under a tension.

13 Claims, 5 Drawing Sheets

100

100

LATCHES FOR HOLDING PRINTING DEVICE ROLLERS IN CONTACT WITH END CAPS

BACKGROUND

Some types of printing devices (e.g., liquid electro photographic printers) include one or more binary ink developers. Printing devices that use binary ink developers are structurally complicated machines and the binary ink developer itself is a complicated and expensive device. A binary ink developer roller eventually may be replaced, and replacement of such a roller may not be easy, particularly in the face of tight tolerance requirements between the roller and other components in the printing device.

DETAILED DESCRIPTION

Figure 1:
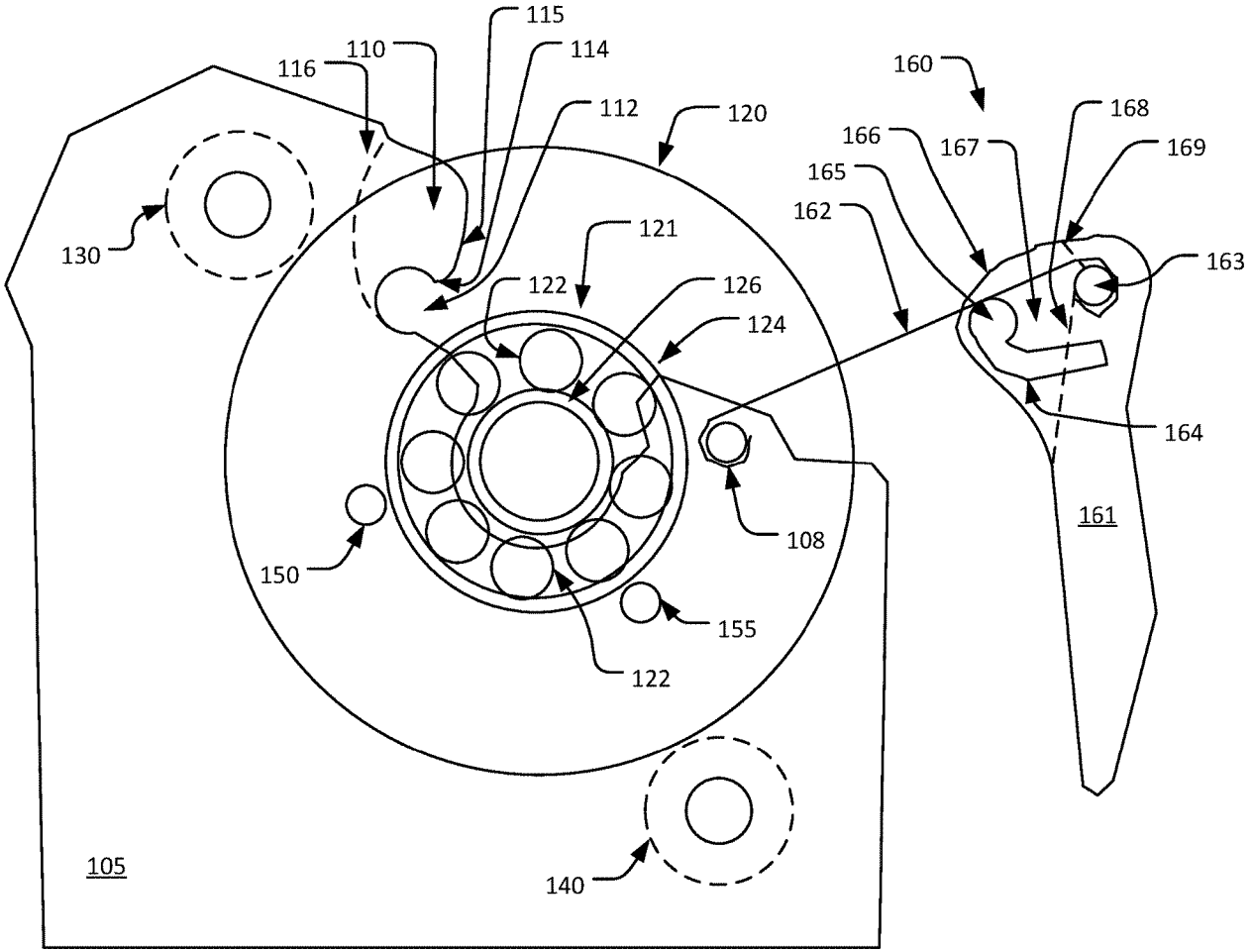
FIG. 1 illustrates a side view of an example printing device roller, end cap, and latch unit in an open position.

In one example, a printing device is described. The printing device may include an end cap having an engaging portion and a hook portion, a roller, and a latch unit to hold the roller in contact with the end cap when the latch unit is in a closed position. The latch unit may include a latch having a protrusion to engage with the engaging portion of the end cap, and a spring attached to the end cap and to the latch. In one example, the hook portion of the end cap is to hold the latch in a closed position in counteraction to a force provided by the spring under a tension.

In another example, a latch unit is described. In one example, the latch unit may include a latch having a first side with a first protrusion and a second side with a second protrusion to engage with an engaging portion of an end cap of a printing device. The latch unit may further include a sheet spring to hold the first protrusion and the second protrusion in contact with the engaging portion of the end cap when the sheet spring is under a tension generated when the sheet spring is pressed against a portion of a roller of the printing device. In one example, the sheet spring is attached to a pin or a bar of the latch extending from the first side of the latch to the second side of the latch.

In another example, a developer unit of a printing device is described. For instance, the developer unit may include a developer roller, an end cap to support the developer roller, and a latch unit. In one example, the end cap may have an engaging portion and a hook portion. In one example, the latch unit may include a latch having a protrusion to engage with the engaging portion of the end cap, and a spring attached to the end cap and to the latch. In one example, the hook portion of the end cap may be to hold the latch in a position with the spring under tension. The tension may be provided by the spring being bent in contact with a portion of the developer roller.

Some types of printing devices (e.g., liquid electro photographic printers) include binary ink developers (BID) units. One of the functions of a binary ink developer unit is to develop a thin, uniform layer of ink to a photo imaging plate (PIP), or PIP drum. A binary ink developer unit may include a developer, or developer roller, which may comprise an elongated cylinder with a metal core and a polyurethane outer layer. The properties of the developer may degrade over time through use. In addition, the developer may be sensitive to mechanical damage. Therefore, the developer may be made as a replaceable component of the binary ink developer unit.

Examples of the present disclosure provide for binary ink developer units, broadly "developer units," with replaceable developers and latch units to secure the developers to the end caps and that fit within the constrained space in which the developer units are intended to be deployed. Example latch units of the present disclosure also provide high holding forces to counteract the nip and gear forces that may push a developer out of position during operation. In addition, even though high holding forces are provided, e.g., 50-600 newtons, example latch units of the present disclosure may also be closed and opened with minimal force, e.g., half of the holding force or less, thereby providing an ergonomic and easy to use design. Solutions for securing a replaceable developer into a developer unit may include screwing the developer in place or using an over-center style of latch. However, using either machine screws or thumb screws may be less user-friendly and less ergonomic than a latch. Furthermore, such solutions that use an over-center style of latch may require additional components, may occupy more space, and may be more costly than the examples of the present disclosure. In addition, two motions may be used to close an over-center style latch: one to hook the latch, and a second to close the latch. In contrast, latch units of the present disclosure may be closed by the operator in a single motion to push the latch closed and hook it into place. These and other aspects of the present disclosure are discussed in greater detail below in connection with the example FIGS. 1-5.

It should be noted that although various examples of the present disclosure may be described with respect to developer units, the present disclosure is not so limited. Rather, examples of the present disclosure relate to securing various types of rollers in various printing devices to the end caps that support the rollers. As such, although examples are primarily described in the context of developer units, it will be appreciated that various other types of rollers may be substituted for a developer in the following description and accompanying figures. As referred to herein, a printing device may comprise such devices as: a personal printer, a mobile printer or a portable printer, an ink-jet printer, a laser-jet printer, a liquid electro photographic printer or press (LEP), a digital press or digital printing press, an offset printing press, a printer-copier, a printer-scanner, a printer-copier-scanner, a printer-copier-fax, and so forth. In addition, as referred to herein a printing fluid may comprise such things as ink, toner, or the like, including but not limited to: dye-based ink, pigment-based ink, electro ink, liquid toner, ultraviolet (UV)-curable ink, and so forth.

Figure 2:
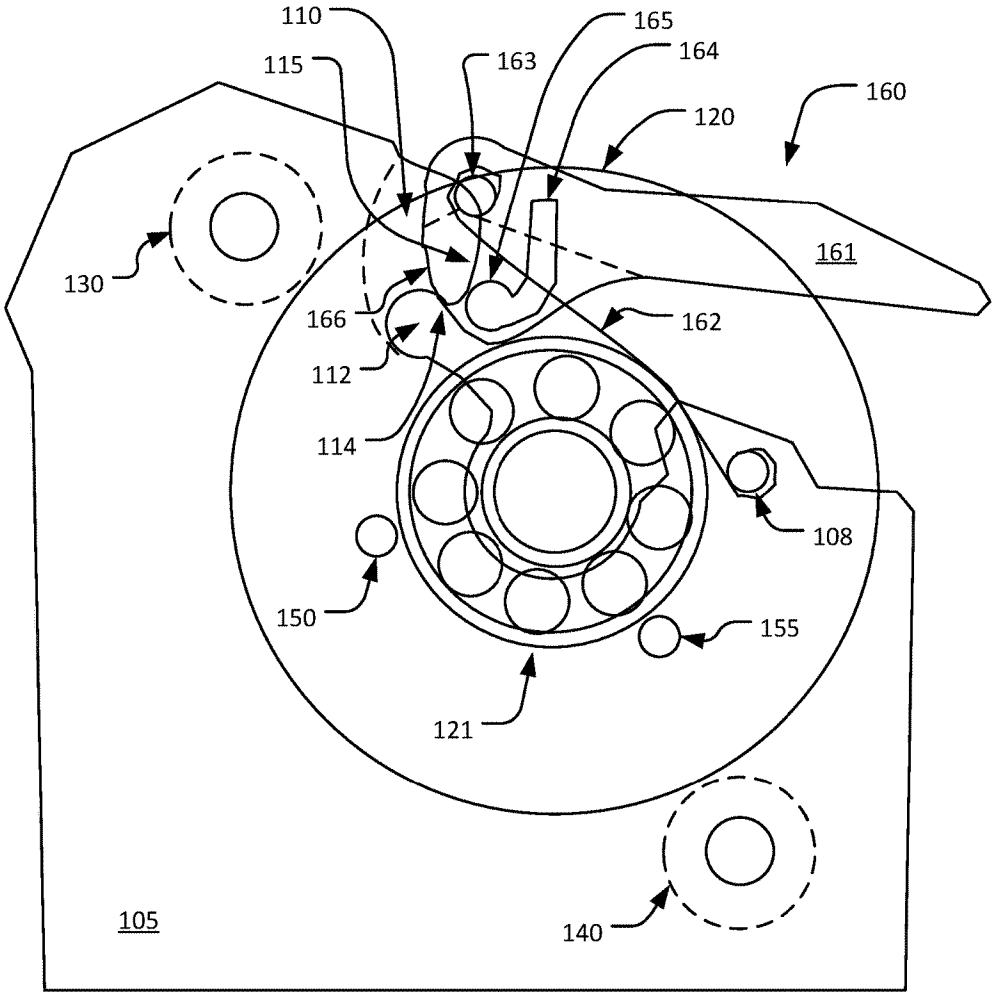
FIG. 2 illustrates a side view of an example printing device roller, end cap, and latch unit in an intermediate position.
Figure 3:
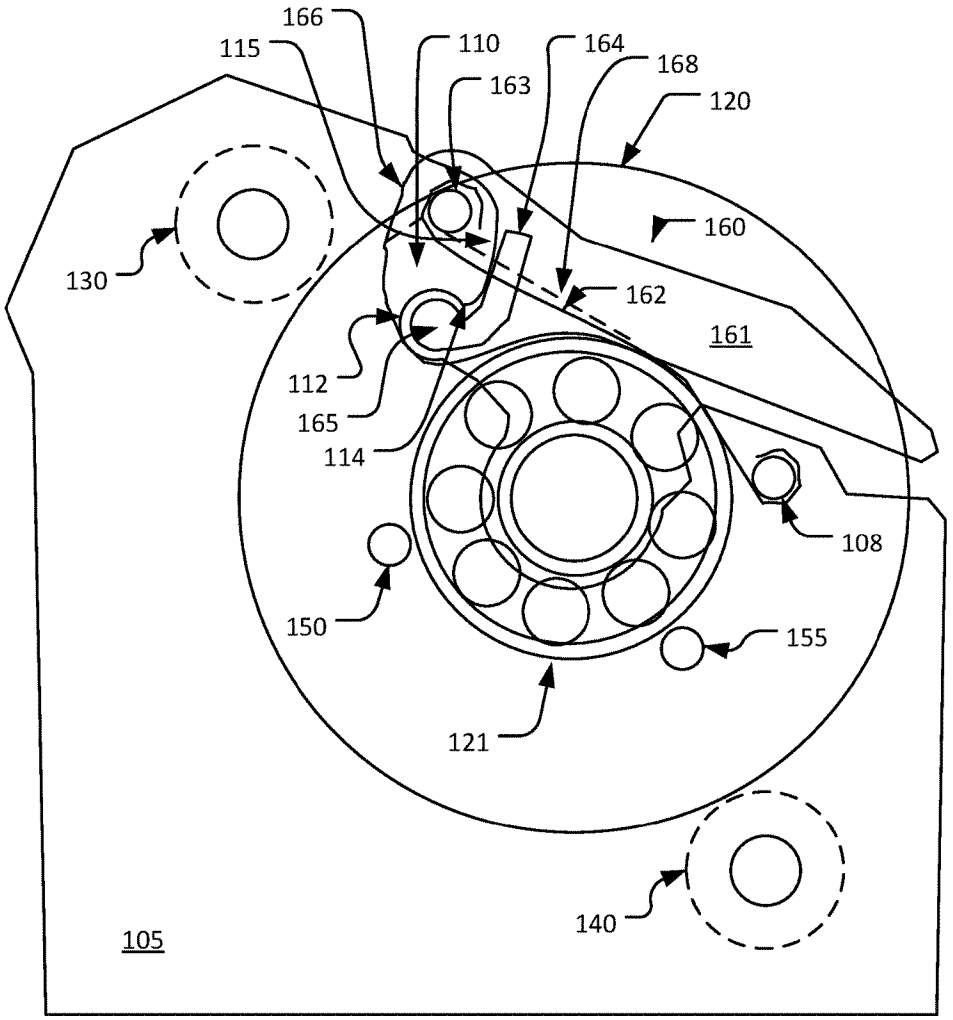
FIG. 3 illustrates a side view of an example printing device roller, end cap, and latch unit in a closed position.
Figure 4:
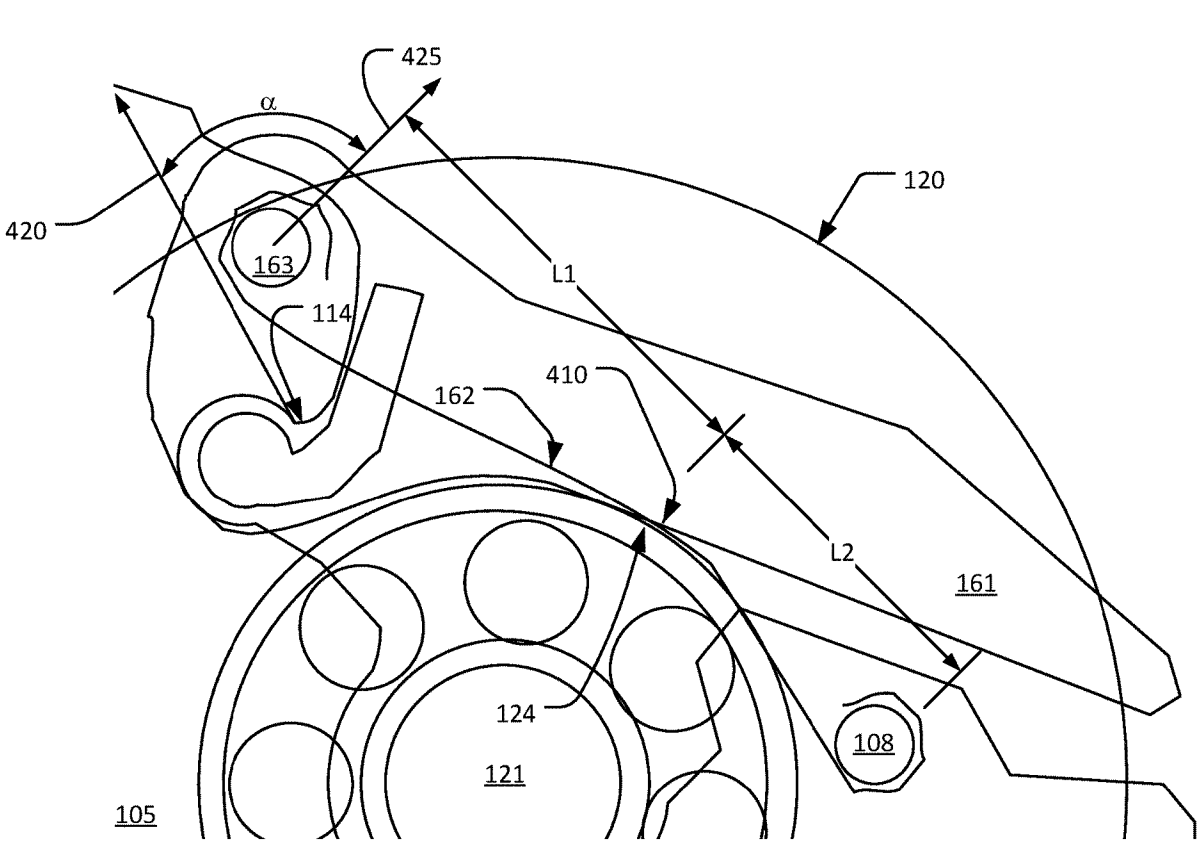
FIG. 4 illustrates a more detailed side view of an example printing device roller, end cap, and latch unit in a closed position.
Figure 5:
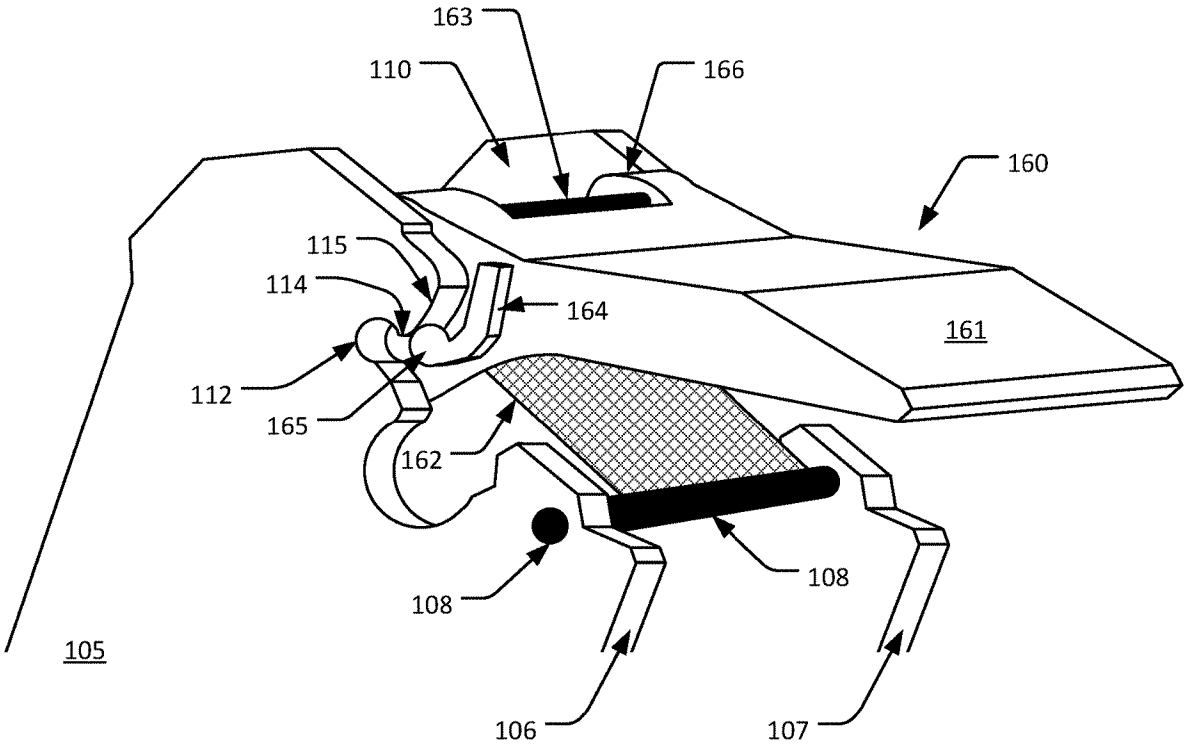
FIG. 5 illustrates an isometric view of an example end cap and latch unit of a printing device.

Referring now to FIGS. 1-5, a portion of an example unit 100, e.g., a developer unit of a printing device, is shown in the respective figures. FIGS. 1-3 illustrate the unit 100 with a latch unit 160 in various positions. For example, FIG. 1 may illustrate the latch unit 160 in an open position, FIG. 2 may illustrate the latch unit 160 in an intermediate, or partially closed position, and FIG. 3 may illustrate the latch unit 160 in a closed position. FIG. 4 illustrates a more detailed view of the unit 100 with the latch unit 160 in a closed position. FIG. 5 illustrates an isometric view of a portion of the unit 100.

As illustrated in FIG. 1, unit 100 may include a developer 120 with a bearing unit 121 sitting on datum pins 150 and 155 of an end cap 105. In one example, the end cap 105 may comprise two parallel portions separated by a gap, where the datum pins 150 and 155 may bridge the gap between the two parallel portions. The parallel portions 106 and 107 of end cap 105 may be seen in FIG. 5, for example. In one example, developer 120 may be a roller comprised of polyurethane over a steel or an aluminum core. For instance, developer 120 may comprise an elongated roller or drum having a length that extends into the page, or orthogonal to the surface of the page as illustrated in FIG. 1. The bearing unit 121 may include an outer race 124, an inner race 126, and bearings 122 between the outer race 124 and the inner race 126. In one example, the datum pins 150 and 155 are positioned within the end cap 105 so as to contact the outer race 124 of the bearing unit 121 approximately 120 degrees apart.

Unit 100 may further include a squeegee roller 130 and a cleaner roller 140, each of which may have a length that extends parallel to a length of the developer 120. In one example, the squeegee roller 130 and the cleaner roller 140 may be spring loaded such that the squeegee roller 130 and cleaner roller 140 are pinched to the developer 120. Thus, squeegee roller 130 and cleaner roller 140 may provide forces that can move the developer 120 out of a position resting upon datum pins 150 and 155. In addition, as illustrated in FIG. 1, developer 120, bearing unit 121, squeegee roller 130, and cleaner roller 140 are partially obstructed by end cap 105.

As illustrated in FIG. 1, the unit 100 may further include a latch unit 160 comprising a latch 161 and spring 162. When the latch unit 160 is open, as in FIG. 1, the developer 120 may be freely moved in and out of the end cap 105. In one example, spring 162 may comprise a sheet spring, e.g., a sheet metal spring. In one example, spring 162 may comprise a steel leaf spring. In one example, the spring may comprise a material with sufficiently high yield stress so that the spring does not plastically deform. For instance, a spring steel that is heat treated may be used to provide a sheet spring with a suitable hardness, e.g., between 4-55 Rockwell hardness C (RHC). In one example, a spring steel, e.g., SAE 1075, with RHC 44-47 may be used. In another example, stainless steel 17-7 conditioned to RH 950 may be used.

In one example, ends of the spring 162 may be wrapped around pins 108 and 163 of the end cap 105 and latch 161, respectively. For example, pin 108 may bridge a gap between two parallel portions of end cap 105. Similarly, latch 161 may have a first side and a parallel second side, one of which is visible in FIG. 1. In one example, the first side and the second side may be integrated together. For example, the latch 161 may comprise a single piece of molded plastic, machined metal, e.g., aluminum, and so forth. However, at least a portion of the latch 161 may comprise a gap between the first side and the second side. In addition, in one example, the latch 161 may include the pin 163 extending across the gap from the first side to the second side of the latch 161 to which the spring 162 may be attached. For example, the spring 162 may comprise a sheet spring, with one end wrapped around and secured to the pin 163. In one example, the gap may comprise a channel 167 that may be defined by a first stop surface 168 and a second stop surface 169. The stop surfaces 168 and 169 may prevent the spring 162 from being overextended in either direction of rotation.

As used herein the term "pin" may refer to an individual component, or may refer to a molded piece of a larger unit. For instance, pin 163 may comprise a bar molded into a single piece of plastic or other material comprising the latch 161. Similarly, pin 108 may comprise a metal pin bridging a gap between two parallel portions of the end cap 105, may comprise a bar molded from a same material as the end cap 105, and so on.

In one example, the end cap 105 includes a hook portion 114 formed between surface 115 and engaging portion 112. In one example, latch 161 also includes a protrusion 165 that may have a shape that is complementary to, or partially complementary to a shape defined by the engaging portion 112, e.g., a circular or cylindrical shape as shown in FIG. 1. In addition, in one example, the latch 161 may include a rib 164 to support the protrusion 165. In one example, the rib 164 may have a shape that is complementary to or partially complementary to the shape of surface 115 of the end cap 105. As illustrated in FIG. 1, the area of end cap 105 that includes the surface 115, hook portion 114, and engaging portion 112 does not extend all the way between two parallel portions of the end cap 105. For instance, the dotted line 116 illustrates where end cap 105 may include a gap between two parallel portions of end cap 105. This cut out region 110 may receive a portion 166 of latch 161 when the latch unit 160 is placed into a closed position, as can be seen in FIG. 3, for example. This cut out region 110 can also be seen in the isometric view of unit 100 in FIG. 5. In one example, the location of pin 108 on the end cap 105 is across from the engaging portion 112, hook portion 114, and surface 115 with respect to the bearing unit 121. For instance, it can be seen in FIG. 1 that pin 108 is on one side of bearing unit 121, while the engaging portion 112, hook portion 114, and surface 115 are across from the pin 108 on the other side of the bearing unit 121. This configuration provides for the spring 162 to be bent and tensioned over the outer race 124 of the bearing unit 121 as the latch 161 is moved into an intermediate position and further into a closed position, as shown in FIGS. 2 and 3 respectively.

Referring now to FIG. 2, as the latch unit 160 is moved from an open position (FIG. 1) into an intermediate position (FIG. 2), a portion of the latch 161 may come into contact with and/or engage with the sloped surface 115 on the end cap 105. In one example, the surface 115 where contact is made by the protrusion 165 is angled outward, such that as the latch 161 is pushed down (in the direction of datum pins 150 and 155), the protrusion 165 is urged to slide toward and into the area defined by engaging portion 112. As can be seen in FIG. 2, as the latch 161 is moved into an intermediate position, the spring 162 contacts a portion of the bearing unit 121 of the developer 120 and begins to press down upon and bend about this portion of the bearing unit 121, thereby generating a tension in the spring 162. A force against the bearing unit 121 by the spring 162 also pushes the bearing unit 121 toward the datum pins 150 and 155.

FIG. 3, illustrates the unit 100 with the latch unit 160 in a closed position. For example, a closed position may comprise the bearing unit 121 being pressed against datum pins 150 and 155 via spring 162, while the latch 161 is held securely in place by the tension in the spring 162 pushing upward (e.g., in a direction perpendicular to a length of the spring 162 and away from datum pins 150 and 155) upon pin 163 and pulling the protrusion 165 of latch 161 against the hook portion 114 of end cap 105. In other words, the hook portion 114 of the end cap 105 may hold the latch 161 in a closed position in counteraction to a force provided by the spring 162 under tension. Thus, due to the orientation of the hook portion 114 and the latch 161, the latch unit 160 remains in a stable, closed position with the spring 162 under tension.

As the latch 161 is pushed further down from the intermediate position (FIG. 2), it may begin to rotate clockwise so that the latch 161 is eventually tucked out of the way (FIG. 3). For example, the latch 161 may not protrude beyond the cross-section of the developer 120 when in the closed position of FIG. 3. As the latch 161 is moved all the way into the closed position of FIG. 3 from the intermediate position of FIG. 2, the spring 162 continues to bend further, thereby increasing the tension in the spring 162 and increasing the force on the bearing unit 121, pressing the bearing unit 121 against datum pins 150 and 155 with the increased force. In one example, the force of the spring 162 on the bearing unit 121 may be in the range of 50-600 newtons.

In one example, and as illustrated in FIG. 3, the latch 161 may be tapered at an end opposite to the pin 163 in order that the cross-section of latch 161 fits within the cross-section of developer 120 when the latch 161 is in the closed position. For example, most of the arc of developer 120 that is exposed beyond the end cap 105 is exposed for the developer 120 to contact a photoconductor layer of a PIP drum. Thus, the latch 161 may sit within the cross-section of the arc of the developer 120 that is exposed from the end cap 120. As such, the latch 161 and latch unit 160 take up little if any additional space beyond that which is already used for the developer 120 and other components of unit 100.

It should be noted that latch 161 may include protrusions and ribs on two opposite/parallel sides of the latch 161, and the end cap 105 may include respective hook portions on two parallel portions of the end cap 105 to engage the protrusions on the two sides of the latch 161. While just one side of the end cap 105 and latch 161 is visible in the side view illustration of FIGS. 1-4, it can still be seen in FIG. 3 that a portion 166 of latch 161 fits within a cut out region 110 of the end cap 105, e.g., between the two parallel portions. These features are also visible in the example isometric view of FIG. 5.

Referring again to FIG. 3, the hook portion 114 of the end cap 105 may hold the latch 161 in place (in a closed position) by providing a static holding force against protrusion 165, opposing a force on the latch 161 generated by the tension in the spring 162. As mentioned above, in one example, shapes of the protrusion 165 and supporting rib 164 may be complementary to shapes of the engaging portion 112, hook portion 114, and surface 115. For instance, it can be seen in FIG. 3 that the rib 164 and protrusion 165 fit tightly against the surface 115, hook portion 114, and engaging portion 112 of end cap 105.

As mentioned above, a purpose of the rib 164 may be to support the protrusion 165 and to fit against surface 115 of end cap 105. Therefore, the rib 164 may be configured to provide support to protrusion 165, but at the same time remain out of the way so that the protrusion 165 of the latch 161 can fit within the engaging portion 112 of the end cap 105. However, in an alternative configuration, the rib 164 may be omitted. For example, the protrusion 165 may comprise a metal pin without an accompanying rib for support. Similarly, if the latch 161 is fabricated from a solid metal, such as machined aluminum, or a composite material, the rib 164 may also be omitted. The latch 161 and latch unit 160 may still be held in the closed position by the hook portion 114 of end cap 105 holding the protrusion 165 within the engaging portion 112.

In one example, squeegee roller 130 and cleaner roller 140 may be spring loaded against the developer 120. When in a closed position (FIG. 3) a force of spring 162 exerted on developer 120 and/or on the bearing unit 121, may have a magnitude so as to hold down the developer 120, e.g., the bearing unit 121 of the developer 120, against the datum pins 150 and 155, while also overcoming the forces on developer 120 from squeegee roller 130 and cleaner roller 140. In addition, as mentioned above, latch 161 may include a channel 167 defined by stop surfaces 168 and 169. Thus, for example, stop surface 169 may prevent the spring 162 from being further bent or extended beyond that which is shown in FIG. 3, thereby helping to prevent permanent deformation of the spring 162.

It should be noted that for illustrative purposes, some of the components of the unit 100 that are labeled in FIG. 1 are not labeled in FIGS. 2 and 3. However, it should be understood that these components may remain within the unit 100 and perform the same functions as described in connection with FIG. 1. In addition, throughout the examples of FIGS. 1-3, the end cap 105 and other components of unit 100 may include additional features that are omitted for ease of illustration. For example, the end cap 105 may include through-holes for attachment to a tray. Still another feature may comprises a set of ridges on the top of the latch 161 to guide a user to an optimal position to push down on the latch 161 in order to put the latch 161 and latch unit 160 in a closed position. It should also be noted that various components may be omitted in various additional examples. For instance, unit 100 may comprise a portion of a printing device that is not a developer unit. As such, developer 120 may comprise a different type of roller. In addition, in such examples, the unit 100 may not include a squeegee roller, a cleaner roller, and so forth.

FIG. 4 illustrates a more detailed view of a portion of unit 100 with latch 161 in a closed position. As shown in FIG. 4, the direction or orientation of the hook portion 114 of end cap 105 is shown by the line 420. A direction of force on the latch 161 provided by the bent spring 162 in a closed position is given by arrow 425. In one example, the angle $\alpha$ between the orientation of hook portion 114 (line 420) and the direction of the force provided by the bent/tensioned spring 162 on the latch 161 (line 425) is less than 90 degrees. Where the angle $\alpha$ is less than 90 degrees, the force of the spring 162 may hold the latch 161 in the closed position. For instance, the latch 161 may be pulled in the direction of the spring force given by arrow 425. However, the hook portion 114 of the end cap 105 may hold the latch 161 in place by engaging protrusion 165 of the latch 161, thereby preventing the latch 161 from moving. A sufficient force lifting the end of the latch 161 opposite to pin 162 may disengage protrusion 165 from engaging portion 112, thereby releasing the latch 161 to the intermediate position of FIG. 2 or open position of FIG. 1.

Examples of the present disclosure may also provide for latch units that have relatively strong holding forces, but that are also relatively easy to disengage. In one example, the latch 161 may provide a mechanical advantage, consistent with the dimensions of the unit 100, while remaining low profile and fitting within the existing footprint/cross-section of the developer 120. FIG. 4 illustrates that spring 162 may comprise a first segment and a second segment when the latch 161 is in the closed position. The first segment, having a length L1, may comprise a segment of the spring 162 between a portion of the spring 162 that contacts a portion of the developer 120 (e.g., contact position 410, where spring 162 contacts outer race 124 of the bearing unit 121) and an end of the spring 162 that is attached to the latch 161 at pin 163. The second segment, having a length L2, may comprise a segment of the spring 162 between contact position 410 and an end of the spring 162 that is attached to the end cap 105 at pin 108. In one example, the ratio of L1 to L2 may be from 2:1 to 4:1. e.g., 3:1. Thus, a force to disengage the latch 161 may comprise half of the holding force or less, thereby providing an ergonomic and easy to use design.

FIG. 5 illustrates an isometric view of the unit 100 of FIGS. 1-4. FIG. 5 may illustrate the latch 161 and latch unit 160 in an intermediate position, e.g., corresponding to the example of FIG. 2. In such an example, the protrusion 165 is not fully within the engaging portion 112 of end cap 105. Features that are more visible in FIG. 5 include the pin 108 bridging the gap between sides 106 and 107 of end cap 105, the cut out region 110 where a portion 166 of latch 161 may be received, and the pin 163 extending between the two parallel sides of the latch 161. The spring 162 may comprise a sheet spring, which has a width that is visible in FIG. 5. In the example of FIG. 5, the spring 162 is attached to pin 108 of end cap 105 and pin 163 of latch 161 as opposite ends. It should be understood that since end cap 105 may include first and second sides 106 and 107, engaging portion 112 may comprise a pair of features on the respective sides 106 and 107, hook portion 114 may comprise a pair of features on the respective sides 106 and 107, surface 115 may comprise a pair of features on the respective sides 106 and 107, and so on. Similarly, latch 161 may include an additional protrusion and an additional rib on a side of the latch 161 that is not visible in FIG. 5, e.g., in a symmetrical configuration to protrusion 165 and rib 164, to engage with features of side 107 of end cap 105. In addition, various components of unit 100 are omitted from FIG. 5 for illustrative purposes. For example, datum pins, a developer and bearing unit, a cleaner roller, a squeegee roller, and so forth are omitted from FIG. 5.

It will be appreciated that variants of the above-disclosed and other features and functions, or alternatives thereof, may be combined into many other different systems or applications. Various presently unforeseen or unanticipated alternatives, modifications, or variations therein may be subsequently made, which are also intended to be encompassed by the following claims.

What is claimed is:

1. A printing device, comprising:

an end cap having an engaging portion and a hook portion, wherein the end cap comprises a first portion that is parallel to a second portion separated by a gap;

a roller; and a latch unit to hold the roller in contact with the end cap when the latch unit is in a closed position, the latch unit comprising:

a latch having a protrusion to engage with the engaging portion of the end cap; and a spring attached to the end cap and to the latch, wherein the hook portion of the end cap is to hold the latch in the closed position in counteraction to a force provided by the spring under a tension, wherein a first end of the spring is attached to a first pin of the end cap that bridges the gap between the first portion of the end cap and the second portion of the end cap and two parallel sides of the latch unit and a second end of the spring is attached to a second pin of the end cap extending between the gap.

2. The printing device of claim 1, wherein the latch unit is to hold the roller in contact with the end cap by pressing a bearing unit of the roller against datum pins of the end cap via the spring under the tension.

3. The printing device of claim 1, wherein a portion of the latch is tapered to fit a cross-section of the latch within a cross-section of the roller when the latch unit is in the closed position.

4. The printing device of claim 1, wherein a bearing unit of the roller is to lie upon datum pins of the end cap that bridge the gap between the first portion and the second portion of the end cap.

5. The printing device of claim 1, wherein the spring comprises a first segment and a second segment when the latch unit is in the closed position, wherein the first segment comprises a segment of the spring between a portion of the spring that contacts a portion of the roller and the first end of the spring that is attached to the latch, wherein the second segment comprises a segment of the spring between the portion of the spring that contacts the portion of the roller and the second end of the spring that is attached to the end cap, wherein a ratio of a length of the first segment to a length of the second segment comprises a ratio of between 2:1 and 4:1.

6. The printing device of claim 1, wherein an angle formed by an orientation of the hook portion of the end cap and a direction of a force on the latch provided by the spring under the tension is less than 90 degrees.

7. A latch unit comprising:

a latch having a first side with a first protrusion and a second side with a second protrusion to engage with an engaging portion of an end cap of a printing device, wherein the end cap comprises a first portion that is parallel to a second portion separated by a gap; and a sheet spring to hold the first protrusion and the second protrusion in contact with the engaging portion of the end cap when the sheet spring is under a tension generated when the sheet spring is pressed against a portion of a roller of the printing device, wherein the sheet spring is attached to a first pin that bridges the gap between the first portion of the end cap and the second portion of the end cap and two parallel sides of the latch unit and a second end of the spring is attached to a second pin of the end cap extending between the gap.

8. The latch unit of claim 7, wherein the sheet spring is further to hold the roller of the printing device in contact with the end cap by pressing a bearing unit of the roller against datum pins of the end cap when the sheet spring is under the tension.

9. The latch unit of claim 7, wherein the portion of the roller comprises a bearing unit.

10. The latch unit of claim 7, wherein the latch includes a channel between the first side and the second side to prevent the sheet spring from being overextended.

11. The latch unit of claim 7, wherein the latch further comprises:

a first rib on the first side to support the first protrusion; and a second rib on the second side to support the second protrusion.

12. A developer unit, comprising:

a developer roller;

an end cap having an engaging portion and a hook portion, wherein the end cap is to support the developer roller, wherein the end cap comprises a first portion that is parallel to a second portion separated by a gap; and a latch unit comprising:

a latch having a protrusion to engage with the engaging portion of the end cap; and a spring attached to the end cap and to the latch, wherein the hook portion of the end cap is to hold the latch in a position with the spring under a tension, wherein the tension is provided by the spring being bent in contact with a portion of the developer roller, wherein a first end of the spring is attached to a first pin of the end cap that bridges the gap between the first portion of the end cap and the second portion of the end cap and two parallel sides of the latch unit and a second end of the spring is attached to a second pin of the end cap extending between the gap.

13. The developer unit of claim 12, wherein an angle formed by an orientation of the hook portion of the end cap and a direction of a force on the latch provided by the spring under the tension is less than 90 degrees.

* * * * *